United States Patent [19]

Chielens et al.

[11] 4,071,081

[45] Jan. 31, 1978

[54] INTERNALLY COOLED ROLLER

[75] Inventors: Alain Chielens, Marcq-en-Baroeul; Jean-Pierre Hénin, Lille, both of France

[73] Assignee: Fives-Cail Babcock, Paris, France

[21] Appl. No.: 697,241

[22] Filed: June 17, 1976

[30] Foreign Application Priority Data

June 17, 1975 France ..... 75 18833

[51] Int. Cl.[2] ..... F28F 7/00

[52] U.S. Cl. ..... 165/82; 165/90; 29/123

[58] Field of Search ..... 29/110, 115, 123, 129.5; 165/86–90, 81–83

[56] References Cited

U.S. PATENT DOCUMENTS

| | | | |
|---|---|---|---|
| 1,897,613 | 2/1933 | Vensen | 165/90 |
| 3,228,462 | 1/1966 | Smith, Jr. | 165/89 |
| 3,625,280 | 12/1971 | Peter | 165/90 |
| 3,852,860 | 12/1974 | Tewes | 29/110 |

*Primary Examiner*—Charles J. Myhre
*Assistant Examiner*—Theophil W. Streule, Jr.
*Attorney, Agent, or Firm*—Kurt Kelman

[57] ABSTRACT

An internally cooled roller particularly useful for continuous casting of metals comprises a roller body and a sleeve mounted on the circumferential surface of the roller body, a conduit for circulating a cooling fluid being defined between the roller body and sleeve. A flange is mounted on one end face of the roller body. The flange has a first tubular member projecting between the sleeve and a reduced diameter end of the roller body surface, a first annular seat being defined by the first tubular member, the sleeve and the roller body surface, and a second tubular member concentrically surrounding the first member and defining therewith a second annular seat. An end of the sleeve projects into the second annular seat and a fluid-tight element is mounted in the first annular seat under compression, the sleeve end being gripped to prevent its radial expansion and thus loosening of the fluid-tight element in the first seat.

7 Claims, 2 Drawing Figures

INTERNALLY COOLED ROLLER

The present invention relates to an internally cooled roller particularly useful in the continuous casting of metals.

It is known to provide rollers of this type which comprise a roller body having an axis, an axially extending circumferential surface about the axis, a first end face extending substantially perpendicularly to the surface at one end thereof and a second end face, and a sleeve mounted on the circumferential surface of the roller body and surrounding the surface, the circumferential roller body surface and the sleeve defining therebetween a helical conduit for circulating a cooling liquid.

The major difficulty encountered in internally cooled rollers of this type is to assure fluid-tightness at each end of the roller between the roller body and the sleeve. Toroidal gaskets may be used for this purpose but when the roller is subjected to high temperatures, as in the use in continuous casting installations, the sleeve tends to expand and thus loosens the gaskets. This happens particularly when the sleeve is mounted on the roller body with some play so as to constitute a thermal shield or, in the absence of any play, when the sleeve and roller body materials have different expansion coefficients.

It is the primary object of this invention to overcome this difficulty and to provide a secure fluid-tight connection between the roller body and the surrounding sleeve.

This object is accomplished according to the invention with a roller body and sleeve of the indicated structure, the one end of the circumferential roller body surface having a reduced diameter, and a flange mounted on the first end face along a plane extending parallel to the first end face. The flange has a first tubular member extending perpendicularly to the plane and projecting between the sleeve and the reduced diameter end of the roller body surface, the first tubular member defining a first annular seat with the sleeve and roller body surface, and a second tubular member of larger diameter than the first tubular member and extending concentrically thereabout, the tubular members defining a second annular seat therebetween, an end of the sleeve projecting into the second annular seat and being gripped thereby to prevent radial expansion of the sleeve end. A fluid-tight element is mounted in the first annular seat and compressed by the projecting first tubular member, the gripped end of the sleeve preventing loosening of the fluid-tight element in the first annular seat.

Figure 1:
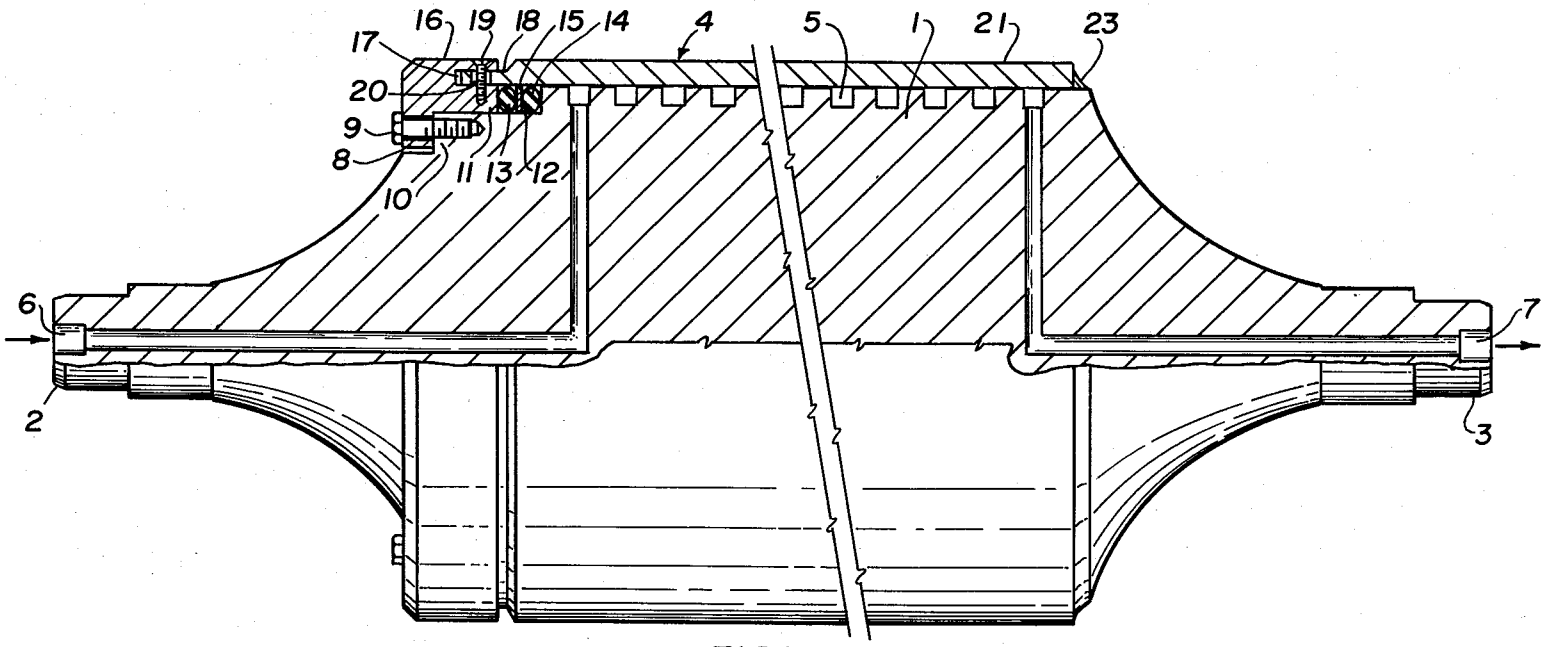
Figure 2:
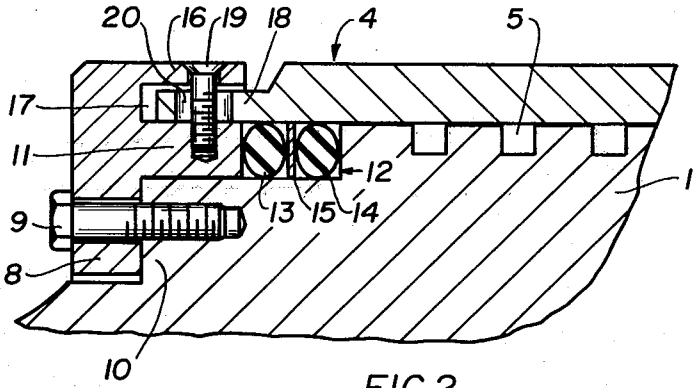

The above and other objects, advantages and features of the present invention will become more apparent from the following detailed description of a now preferred embodiment thereof, taken in conjunction with the accompanying drawing wherein FIG. 1 shows a side elevational view, in partial axial section, of a roller according to this invention and FIG. 2 is an enlarged axial section showing a detail.

Referring now to the drawing, there is shown roller body 1 having an axis and an axially extending circumferential surface about the axis, trunnion 2 extending from a first end face extending substantially perpendicularly to the surface at one end thereof and trunnion 3 extending from a second end face, the trunnions being coaxial with the roller body. Sleeve 4 is mounted on the circumferential surface of the roller body and surrounds the surface, helical groove 5 in the roller body surface defining with sleeve 4 a conduit for circulating a cooling fluid, such as water, for the internal cooling of the roller. One end of groove 5 is in communication with cooling fluid inlet channel 6 extending axially through trunnion 2 and the opposite groove end is in communication with fluid outlet channel 7 extending axially through trunnion 3, thus enabling the fluid to be circulated through helical groove 5. Obviously, the fluid may be circulated in the other direction, i.e. channel 7 could be the inlet and channel 6 the outlet for the fluid.

According to the invention, the one end of the circumferential roller body surface has a reduced diameter and flange 8 is mounted on the first end face along a plane extending parallel to the first end face. The flange has first tubular member 11 extending perpendicularly to the plane and projecting between thin-walled sleeve 4 and the reduced diameter end of the roller body surface. The first tubular member defines first annular seat 12 with sleeve 4 and the roller body surface. A second tubular member 16 of larger diameter than first tubular member 11 extends concentrically thereabout, the tubular members defining second annular seat 17 therebetween. End 18 of sleeve 4 projects into second annular seat 17 and is gripped thereby to prevent radial expansion of sleeve end 18. A fluid-tight element comprised of toroidal gaskets 13, 14 with metallic washer 15 interposed therebetween, is mounted in first annular seat 12 and is compressed by the projecting first tubular member. The gripped end of sleeve 4 prevents loosening of gaskets 13, 14 in seat 12.

Advantageously and as illustrated, projecting end 18 of sleeve 4 has a reduced thickness and the outer diameter of second tubular member 16 is the same as that of sleeve 4 so as to produce a smooth roller surface and a continuous operating generatrix along the entire length of the roller.

Also, the axial length of second annular seat 17 exceeds that of sleeve end 18 projecting thereinto whereby the sleeve, when cold, has axial play in seat 17 and is able to expand axially when subjected to heat.

As shown, means is provided for holding sleeve 4 on roller body 1 against relative rotation, the illustrated holding means comprising a plurality of pins 19 extending radially through tubular members 11 and 16 and axially elongated slots 20 in sleeve end 18 projecting therebetween The axial elongation of slots 20 permits axial displacement of the sleeve. The illustrated pins are headed screws flush with the outer surface of the roller so as to maintain the continuous operating generatrix thereof.

While it would be possible to provide the same flange mounting at the other end of the roller, the illustrated embodiment provides for the other sleeve end to be welded to the roller body at 22 so that the other sleeve end is fixed to the roller body adjacent trunnion 3.

In operation, when the roller is subjected to high temperatures, the radial play between projecting sleeve end 18 and tubular member 16 disappears due to the expansion of the sleeve and the sleeve is thus blocked at both ends while permitting an axial displacement of the sleeve. At any rate, gaskets 13 and 14 remain tight to prevent any leakage of fluid even if sleeve 4 had a tendency to be deformed.

Various modifications in the illustrated embodiment are possible. For instance, projecting sleeve end 18 need not be of reduced thickness and the diameter of tubular member 16 could exceed that of sleeve 4 if the working generatrix is of reduced length and need not extend to the tubular member. The projecting sleeve end may be affixed to the flange and/or roller body in any suitable manner other then headed screws 19. Similarly, the other sleeve end may be affixed to the roller body in any suitable manner. Various forms of cooling fluid circulation conduits may be provided, including, for instance, an annular cooling chamber between the roller body and the sleeve.

Rollers of this type may be incorporated in any suitable continuous metal casting apparatus for manufacturing ingots, billets and the like, such as shown, by way of example, in U.S. Pat. Nos. 3,495,651 and 3,370,641 whose disclosures are incorporated herein by way of reference as casting apparatus comprising the improved internally cooled rollers.

What is claimed is:

1. An internally cooled roller comprising 1. a roller body having an axis, an axially extending circumferential surface about the axis, a first end face extending substantially perpendicularly to the surface at one end thereof and a second end face, the one end of the circumferential surface having a reduced diameter,
2. a sleeve mounted on the circumferential surface of the roller body and surrounding the surface,
   a. the circumferential roller body surface and the sleeve defining therebetween a conduit for circulating a cooling fluid,
3. a flange fixed on the first end face along a plane extending parallel to the first end face, the flange having
   a. a first tubular member extending perpendicularly to the plane and projecting between the sleeve and the reduced diameter end of the roller body surface, the first tubular member defining a first annular seat with the sleeve and roller body surface, and
   b. a second tubular member of larger diameter than the first tubular member and extending concentrically thereabout, the tubular members defining a second annular seat therebetween, an end of the sleeve projecting into the second annular seat and being gripped thereby to prevent radial expansion of the sleeve end, and
4. a fluid-tight element mounted in the first annular seat and compressed by the projecting first tubular member, the gripped end of the sleeve preventing loosening of the fluid-tight element in the first annular seat.

2. The internally cooled roller of claim 1, wherein the axial length of the second annular seat exceeds that of the sleeve end projecting thereinto whereby the sleeve may expand axially.

3. The internally cooled roller of claim 1, further comprising means holding the sleeve on the roller body against relative rotation.

4. The internally cooled roller of claim 3, wherein the holding means comprises a plurality of pins extending radially through the tubular members and axially elongated slots in the sleeve end projecting therebetween.

5. The interanlly cooled roller of claim 1, wherein the projecting end of the sleeve has a reduced thickness, the outer diameter of the second tubular member being the same as that of the sleeve.

6. The internally cooled roller of claim 1, wherein the other end of the sleeve is rigidly fixed to the roller body at the second end face.

7. The internally cooled roller of claim 6, wherein the other sleeve end is welded to the roller body.

* * * * *